US008347806B2

(12) United States Patent
Griffin

(10) Patent No.: US 8,347,806 B2
(45) Date of Patent: Jan. 8, 2013

(54) ANCHOR RAISING APPARATUS

(75) Inventor: Mark Griffin, Hollywood, FL (US)

(73) Assignee: Griffin Clip, Inc., Hollywood, FL (US)

( * ) Notice: Subject to any disclaimer, the term of this patent is extended or adjusted under 35 U.S.C. 154(b) by 273 days.

(21) Appl. No.: 12/837,560

(22) Filed: Jul. 16, 2010

(65) Prior Publication Data

US 2012/0012045 A1 Jan. 19, 2012

(51) Int. Cl.
*B63B 21/24* (2006.01)

(52) U.S. Cl. ..... 114/293; 24/131 R

(58) Field of Classification Search ..... 114/297, 114/293; 24/131 R, 115 N, 115 R
See application file for complete search history.

(56) References Cited

U.S. PATENT DOCUMENTS 220,319 A * 10/1879 Wakeley ..... 24/131 R
2,876,517 A * 3/1959 Menloe ..... 24/131 R
3,094,095 A 6/1963 Litchfield et al.
3,910,226 A * 10/1975 McGahee ..... 116/173
3,913,514 A 10/1975 Reynolds
4,067,287 A 1/1978 Sabella
4,161,922 A 7/1979 Fogg
4,928,618 A * 5/1990 Kubli ..... 114/293
5,666,899 A 9/1997 Andersen
5,797,340 A 8/1998 Peeters

* cited by examiner

*Primary Examiner* — Stephen Avila
(74) *Attorney, Agent, or Firm* — Mark D. Bowen; Malin Haley DiMaggio & Bowen, P.A.

(57) ABSTRACT

An anchor retrieval system for manually retrieving a submerged anchor without requiring heavy pulling includes an anchor retrieval apparatus generally in the form of a clip formed from cylindrical stainless steel fabricated into a unique shape the permits the device to be quickly connected to an anchor line by a simple sliding motion. The clip is further adapted by the attachment of a buoyant member, such as a buoy, to provide a buoyant lifting force. Once the clip is connected to the anchor line anchor retrieval system is tossed into the water and travels down the anchor line as the boat motors away from the buoy until the buoyant force lifts the anchor from the sea floor, whereafter the anchor line is manually drawn in to the boat as the anchor is buoyantly suspended near the surface.

4 Claims, 4 Drawing Sheets

ANCHOR RAISING APPARATUS

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to an apparatus for raising deployed marine anchors, and more particularly to an apparatus for retrieving a deployed boat anchor connected to the boat by an anchor line.

2. Description of Related Art

Retrieving a deployed boat anchor can be a time consuming chore requiring the exertion of tremendous force. Vessel operators can become particularly frustrated when forced to repeatedly retrieve an anchor that fails to set after having been deployed into deep water.

As a result, the background art reveals a number of float assisted anchor raising devices. U.S. Pat. No. 3,094,095, issued to Litchfield et al., discloses a method and apparatus for raising anchors using a buoyant member attached to an anchor line via a coil member. U.S. Pat. No. 3,913,514, issued to Reynolds, discloses a boat anchor retrieving apparatus having a buoyant structure that is slidably attached to the anchor line by an annular member, or alternatively using a U-shaped member. U.S. Pat. No. 4,067,287, issued to Sabella, discloses an anchor raising device having an openable tubular sleeve that is affixed to an anchor line. U.S. Pat. No. 4,161,922, issued to Fogg, discloses an anchor caddy for use in raising an anchor. The device includes a float attached to a pulley contained within a housing. Movable deflector plates may be deployed to increase drag. U.S. Pat. No. 5,666,899, issued to Andersen, discloses a float catch for a boat anchor retrieval system. U.S. Pat. No. 5,797,340, issued to Peeters, discloses an anchor retrieval system comprising a buoy secured to an anchor retrieval device comprising a generally annular body having an openable end configured to a closed position by a lock ring.

The anchor pull devices in the background art are all burdened by significant limitations and disadvantages including overly complex structures that complicate deployment and use. In addition, the devices of the background art include a number of moving parts that are prone to breakage and failure. Accordingly there exists a need in the art for improvements in the field of anchor retrieval devices.

BRIEF SUMMARY OF THE INVENTION

The present invention overcomes the limitations and disadvantages in the art by providing an improved anchor retrieval system for manually retrieving a submerged anchor without requiring heavy pulling. An anchor retrieval system in accordance with the present invention includes an anchor line clip generally formed from an elongate stainless steel rod fabricated into a unique shape the permits the device to be quickly connected to an anchor line by a simple sliding motion. The clip is further adapted by the attachment of a buoyant member, such as a buoy, to provide a buoyant lifting force. Once the clip is connected to the anchor line anchor retrieval system is tossed into the water and travels down the anchor line as the boat motors away from the buoy until the buoyant force lifts the anchor from the sea floor, whereafter the anchor line is manually drawn in to the boat as the anchor is buoyantly suspended near the surface. Use of an anchor clip in accordance with the present invention simplifies anchor retrieval by eliminating the need to physically raise the anchor from the sea floor by hand.

Accordingly, it is an object of the present invention to provide an improved anchor retrieval system.

Another object of the present invention is to provide an anchor retrieval system having a clip adapted for quick and easy attachment to an anchor line without the use of any moving parts.

In accordance with these and other objects, which will become apparent hereinafter, the instant invention will now be described with particular reference to the accompanying drawings.

DETAILED DESCRIPTION OF THE INVENTION

Figure 1:
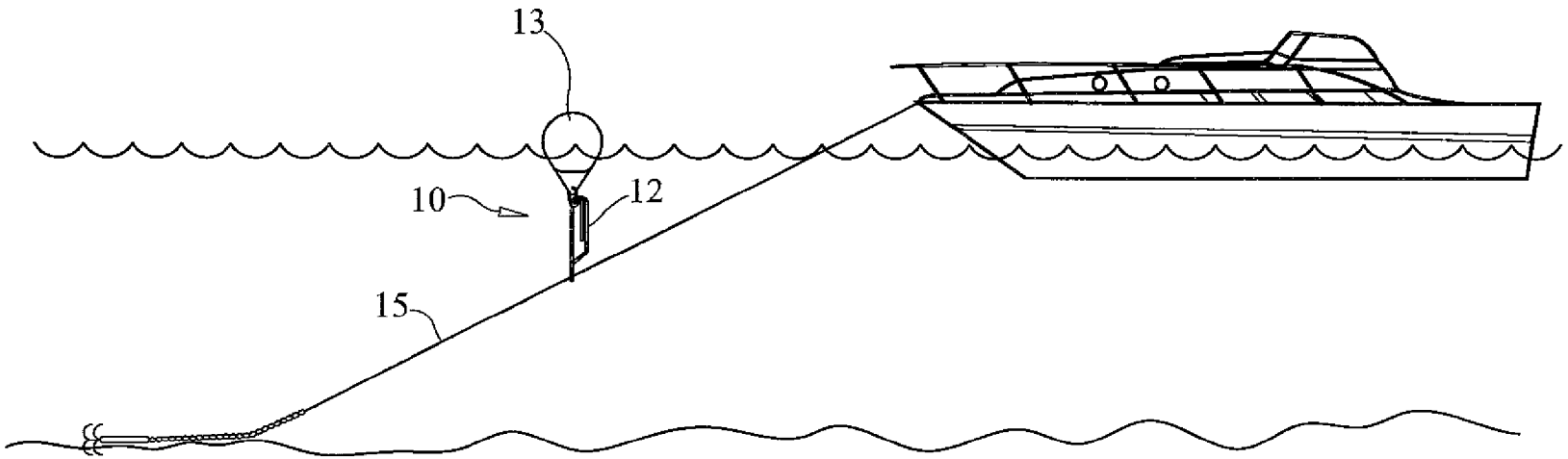
FIG. 1 illustrates an anchor raising apparatus in accordance with the present invention.
Figure 2:
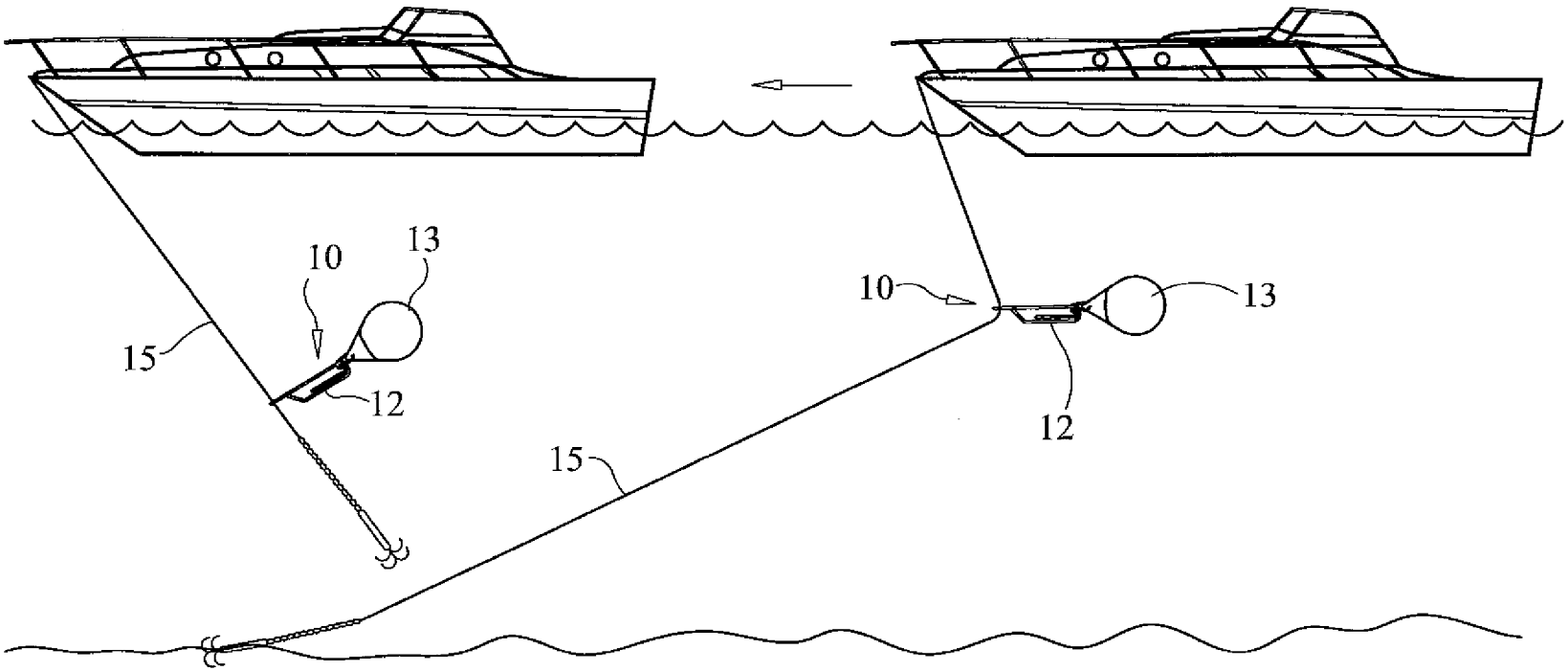
FIG. 2 illustrates the anchor raising apparatus in use raising an anchor.

Turning now to the drawings, FIGS. 1-7 depict a preferred embodiment of an anchor retrieval system, generally referenced as 10, in accordance with the present invention. Anchor retrieval system 10 includes an anchor line clip 12 having a unique structure that allows for quick and easy attachment thereof to an anchor line without the use of any moving parts. Anchor line clip 12 is preferably fabricated from a length of stainless steel rod. It should be noted, however, that a clip in accordance with the present invention may be fabricated from, any suitable alternate material, such as aluminum, titanium, or any other suitable material. In addition, a tubular element of suitable strength may be used to form clip 12 as opposed to a generally solid rod structure. As should be apparent, the anchor line clip 12 is preferably formed by bending and welding. Anchor line clip 12 provides a significant advancement in the anchor retrieval art by providing a unitary structure for a clip that is easily attachable to a buoy 13 and an anchor line 15 and provides a reliable connection thereto without requiring any moving parts or knotted connections as illustrated in FIGS. 1 and 2. Buoy 13 may be attached using any suitable connection apparatus including a carabiner, clip, rope, chain, or any other suitable means of attachment.

Figure 4:
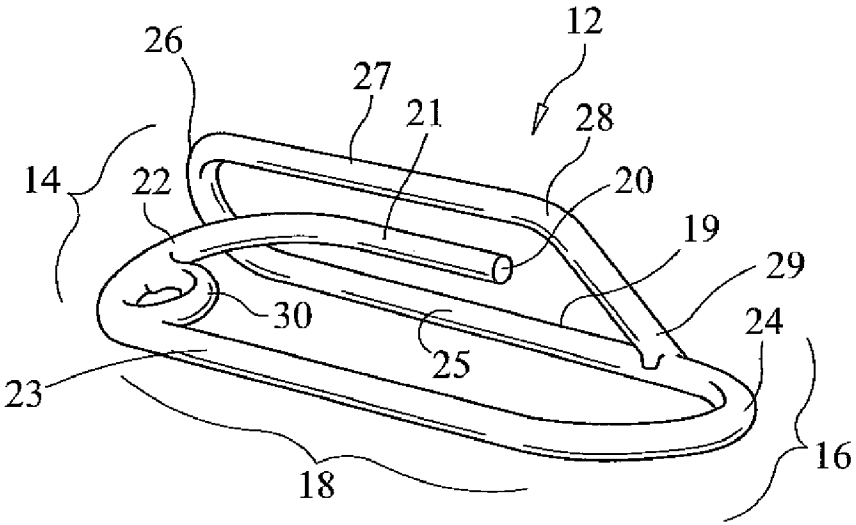
FIGS. 3 and 4 are perspective views of an anchor raising apparatus in accordance with the present invention.
Figure 3:
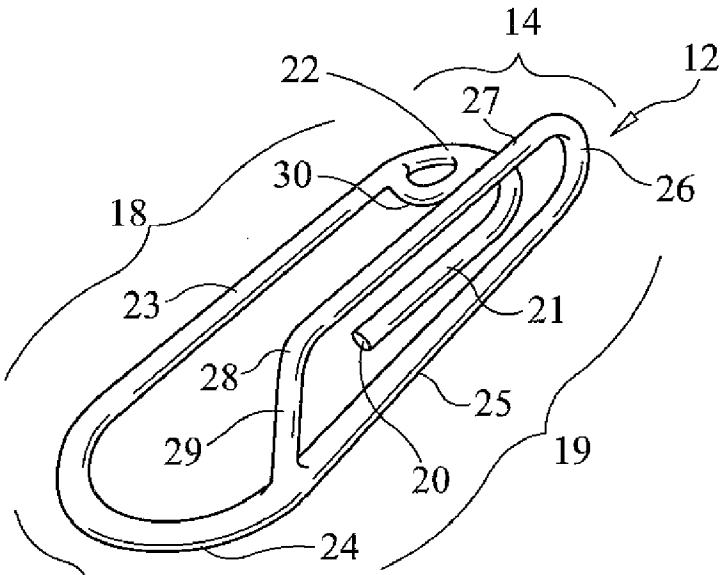

FIGS. 3 and 4 depict prospective views of anchor raising apparatus, primarily comprising a clip 12. Anchor clip 12 has a top end, generally referenced as 14, a bottom end, generally referenced as 16, and two opposing lateral sides, generally referenced as 18 and 19, extending between the bottom end 16 and top end 14. As noted above, clip 12 is preferably fabricated starting from a generally cylindrical and straight solid rod of stainless steel that is formed into the shape depicted in FIG. 1. As should be apparent, however, clip 12 may be fabricated from tubular material, composite material, or any other suitable material of sufficient strength. Anchor clip 12 has a shape that can be described by starting from a first or starting end 20 disposed approximately midway between the top end 14 and bottom end 16 and disposed generally above a first plane containing opposing lateral sides 18 and 19. More particularly, clip 12 has a first leg 21 originating at a starting end 20 (as should be apparent, starting end 20 identifies the originating end of the rod member) and extending toward top end 14 where the clip forms a downwardly angled, generally U-shaped bend forming a turn of approximately 180° (e.g. a U-turn) 22 whereafter a second leg 23 forms a first lateral side 18. Second leg 23 runs generally along a first plane toward the bottom end 16 wherein a second generally U-shaped bend 24 is formed, which bend 24 also falls generally within the first plane. A third leg 25 of the clip then extends toward the top end 14 from second bend 24 forming the second lateral side 19 which falls generally within the same first plane as leg 23. As third leg 25 approaches the top end 14, it transitions to form an approximately 180° bend, referenced as 26 while projecting slightly inwardly (i.e. toward the center) and upwardly (relative to the first plane) whereafter a fourth leg 27 of the clip extends generally parallel to each of the first leg 21, second leg 23 and third leg 25. Fourth leg 27 terminates in a bend 28, and a fifth leg 29 extends downward and outwardly from bend 28 and terminates prior to the bottom end 16 and is joined (as by welding) with third leg 25 of clip body 12. This structure essentially foams a loop structure falling within a plane that is angularly disposed approximately 90° relative to the above-referenced first plane that contains legs 23, bend 24, and leg 25. While the preferred embodiment contemplates an angular relation of approximately 90° between the first and second planes discussed herein, it should be apparent that variations of said angular relation may be employed within the scope of the present invention. This loop structure (formed by lets 25, 27, 29, and bends 26 and 28 is disposed in generally surrounding relation leg 21, with leg 21 disposed approximately equidistant or midway between legs 25 and 27. The spatial relation between the first leg 21 and the surrounding loop structure comprises a significant important structural configuration of the clip by providing a structure that will receive an anchor line within the clip body and prevent unintended disconnection without requiring a knot or other means of attachment. Finally, a generally C-shaped rod member 30 is welded at the first bend 22 to form a loop for attachment of a buoy 13. A further significant aspect of the present invention involves processing clip 12 to achieve a uniform finish. More particularly, clip 12 is preferably subject to an electropolishing process so as to remove contaminants from the surface of the clip thereby resulting in a uniform finish.

Figure 7:
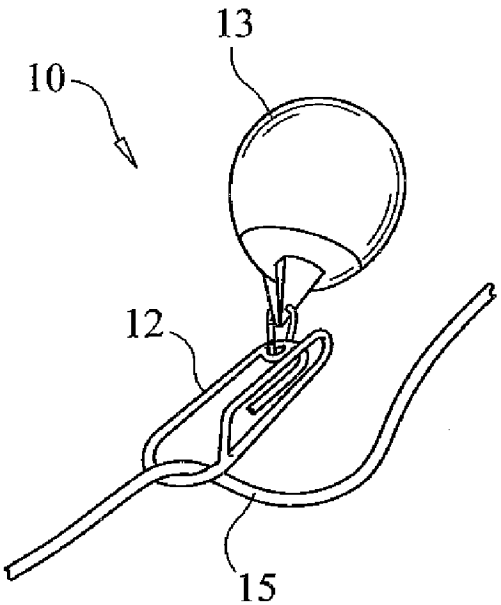
FIGS. 5-7 illustrate attachment of an anchor raising apparatus of the present invention to an anchor line.
Figure 6:
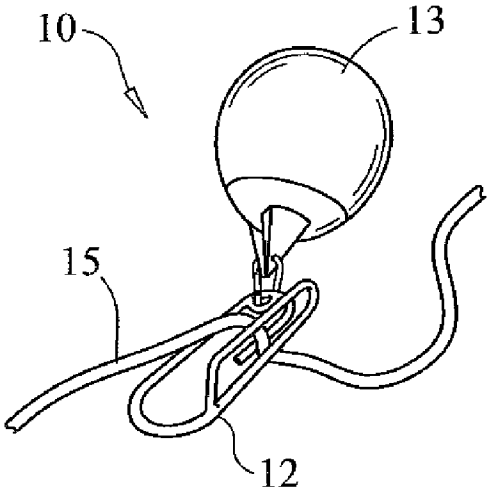
Figure 5:
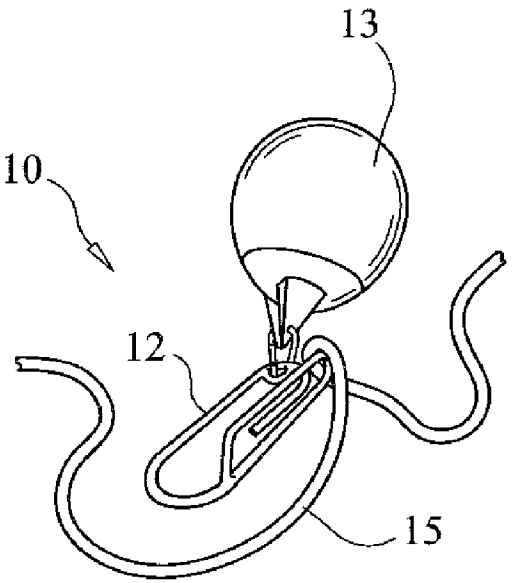

FIGS. 5-7 illustrate the attachment of clip 12 to a buoy 13 and anchor line 15. As seen in FIGS. 5-7 clip 12 is attached to anchor line 15 by sliding anchor line 15 through clip end 14 between turned sections 22 and 26 down past the end 20. Once attached, the anchor clip assembly, including clip 12 and an attached buoy 13 are tossed overboard as illustrated in FIG. 1. As best illustrated in FIG. 2, clip 12 functions by travelling downward along anchor line 15 as the boat moves forward. When the clip 12 reaches the end of the anchor line, the buoyant force exerted by attached buoy 13 functions to pull and raise the anchor to the surface whereafter it may be retrieved without requiring the retrieving individual to pull the heavy anchor upward.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An anchor raising apparatus comprising:

a clip body formed by at least one generally cylindrical rigid member generally characterized as forming a structure having a top end, a bottom end, and two opposing lateral sides including first and second lateral sides;

said clip body having an originating end of said cylindrical member, said originating end disposed approximately midway between said top end and said bottom end, said originating end disposed generally above a first plane generally containing said opposing lateral sides;

said cylindrical member extending from said originating end toward said clip body top end wherein said cylindrical member forms a first, downwardly angled, bend of approximately 180° whereafter said cylindrical member extends along a generally linear axis and forming said first lateral side generally within said first plane and extending toward said bottom end of said clip body wherein said cylindrical member forms a second bend of approximately 180° falling generally within said first plane;

said cylindrical member extending from said second angled bend along a generally linear axis toward said top end and forming said second lateral side, said second lateral side generally falling within said first plane wherein said cylindrical member forms an inward and upwardly disposed angled bend of approximately 180° whereafter said cylindrical member extends generally parallel to said second lateral side and extends in a generally downward and outwardly disposed leg that terminate in a welded connection with a portion of said cylindrical member forming said second lateral side; and an arcuate shaped member having terminal ends attached to said clip body in proximity to said first bend to form a loop.

2. An anchor raising apparatus according to claim 1, wherein said cylindrical member comprises stainless steel tubing.

3. An anchor raising apparatus comprising:

a clip body formed by a generally cylindrical member generally characterized as forming a structure having a top end, a bottom end, and opposing first and second lateral sides;

said clip body having an originating end of said cylindrical member, said originating end disposed approximately midway between said top end and said bottom end, said originating end disposed generally above a first plane generally containing said opposing lateral sides;

a first leg extending from said originating end toward said clip body top end wherein said cylindrical member forms a first downwardly angled bend of approximately 180°;

a second leg extending from said first downwardly angled bend along a generally linear axis toward said clip body bottom end wherein said cylindrical member forms a second bend of approximately 180°;

a third leg extending from said second bend along a generally linear axis toward said clip body top end wherein said cylindrical member forms an inward and upwardly angled third bend of approximately 180°;

said second leg and said second bend and said third leg all falling generally within a first plane;

a fourth leg extending from said third bend along a generally linear axis toward said clip body bottom end, said third leg, said third bend, and said fourth leg all falling generally within a second plane, said second plane angularly disposed relative to said first plane;

said fourth leg terminating at a bend, and a firth leg extending from said bend and terminating in a welded connection with said third leg; and said clip body defining a loop in proximity to said first downwardly angled bend.

4. An anchor raising apparatus according to claim 3, further including a buoy attached to said clip body within said loop.

* * * * *